US006152652A

United States Patent [19]

Mosby

[11] Patent Number: 6,152,652

[45] Date of Patent: Nov. 28, 2000

[54] APPARATUS AND METHOD FOR INSTALLING A DYNAMOMETER PIT IN CEMENTITIOUS MATERIAL

[76] Inventor: Sammy J. Mosby, 10987 Mann Rd., Wilton, Calif. 95693

[21] Appl. No.: 09/270,235

[22] Filed: Mar. 15, 1999

[51] Int. Cl.[7] ..... E02B 13/00; E02D 27/00

[52] U.S. Cl. ..... 405/52; 405/36; 405/53; 405/55; 52/169.7; 52/302.1

[58] Field of Search ..... 405/52, 53, 55, 405/36; 52/169.6, 169.7, 302.1; 249/DIG. 3

[56] References Cited

U.S. PATENT DOCUMENTS

| | | | |
|---|---|---|---|
| 2,910,759 | 11/1959 | Lifter et al. | 249/141 |
| 3,206,823 | 9/1965 | Walter | 249/1 |
| 3,610,564 | 10/1971 | Mattingly | 249/DIG. 3 X |
| 3,731,448 | 5/1973 | Leo | 52/592.1 |
| 3,906,688 | 9/1975 | Witte | 52/152 |
| 4,060,946 | 12/1977 | Lang et al. | 52/169.7 |
| 4,324,133 | 4/1982 | Stevenson | 73/117 |
| 4,934,122 | 6/1990 | Linquist | 52/741 |
| 4,948,296 | 8/1990 | Salter | 52/169.7 X |
| 5,107,872 | 4/1992 | Meincke | 134/56 R |
| 5,154,076 | 10/1992 | Wilson et al. | 73/117 |
| 5,421,671 | 6/1995 | Lewis | 406/52 |
| 5,450,748 | 9/1995 | Evans et al. | 73/117 |
| 5,452,605 | 9/1995 | Wilson et al. | 73/117 |

*Primary Examiner*—Eileen D. Lillis
*Assistant Examiner*—Jong-Suk Lee
*Attorney, Agent, or Firm*—Heisler & Associates

[57] ABSTRACT

A pit assembly 10 is provided to assist in the installation of a pit, such as a dynamometer pit, into cementitious material. The pit assembly 10 includes a pan 20 which has an open top and an interior region having a desired size for housing equipment, such as a dynamometer. A floor of the pan 20 is preferably at least partially sloped so that any liquids within the pan 20 migrate to a sump 40 in the pan 20. A rebar cage 50 surrounds the pan 20. The rebar cage 50 is securely attached to the pan 20 through ties 52, 54, 56. The rebar cage 50 includes various different loops 60, 62, 64 and other rebar segments forming the rebar cage 50. The rebar cage 50 is attached to the pan 20 before the cementitious material is poured around the pit assembly 10 and before the pan 20 is placed in the desired position. Hence, the pit assembly 10 including the pan 20 and rebar cage 50 are prefabricated so that the entire pit assembly 10 can be readily positioned, with spacing between the rebar cage 50 and the pan 20 properly maintained. After the pit assembly 10 has been positioned as desired, cementitious material is poured in a manner surrounding the rebar cage 50 and abutting against the pan 20, with a surface of the cementitious material preferably flush with a rim 22 of the pan 20. Equipment, such as a dynamometer, can then be located within the pit formed by the pan 20 of the pit assembly 10.

20 Claims, 4 Drawing Sheets

APPARATUS AND METHOD FOR INSTALLING A DYNAMOMETER PIT IN CEMENTITIOUS MATERIAL

FIELD OF THE INVENTION

Floors of vehicle service bays which have been equipped with dynamometers therein located within a pit below a surface of the floor of the service bay. More particularly, structures for instillation along with cementitious material to assist in the formation of the pit in the cementitious material of the floor.

BACKGROUND OF THE INVENTION

Many vehicle inspection and vehicle analysis procedures require placement of drive wheels of the vehicle on a dynamometer. A dynamometer is a structure which allows the drive wheels of the vehicle to rotate while the vehicle remains stationary. Dynamometers can be fitted with various different sensors, such as sensors to measure the power which is being outputted by the drive wheels of the vehicle. When a vehicle service bay is to be fitted with a dynamometer, it is preferably that the dynamometer be located at least partially below a surface of cementitious material forming the floor of the service bay. Hence, a pit extending below the surface of the cementitious material is required. The dynamometer can then be installed within the pit in a manner which allows a vehicle to be driven off of the floor and onto the dynamometer without requiring that the vehicle ride up a ramp or otherwise perform a complex maneuver.

The cementitious material which is used to form a floor of a vehicle service bay or similar surface typically is formed from appropriate initial concrete materials, combined with water, and then poured in place before being allowed to harden into the desired final shape. The initial concrete materials typically include portland cement, sand, aggregate, lime and water. When this concrete material is in liquid form it can be easily poured into forms which remain in place until the materials harden. The forms are then removed and the desired finished contour for the cementitious material remains.

Hence, when a pit is to be formed in a floor of a vehicle service bay, an area is initially excavated surrounding the location where the pit is desired. Forms are then put in place where the pit is desired to prevent the concrete or other initial cementitious material from filling up the pit when poured. Before the concrete is poured, it is desirable that steel reinforcing bar, called "rebar," be oriented strategically below the surface for the cementitious material and surrounding the pit region. The rebar significantly enhances the strength of the cementitious material and allows the cementitious material to more effectively support the weight of vehicle wheels in the area surrounding the dynamometer pit. Once the rebar is in place, the concrete or other cementitious material is poured up to the desired level for the surface. The cementitious material is then allowed to harden by evaporation of the water from the cementitious material. Finally, the forms are removed so that the pit remains.

While this process of forming a pit within a surface of cementitious material is generally effective, it suffers from a variety of drawbacks. The process of properly orienting the rebar and positioning the temporary forms in place to form the pit can be particularly time consuming. If the forms are not properly spaced relative to the rebar, the strength of the cementitious material is degraded. Also, the forms cannot be removed until the cementitious material is hardened. Hence, installers of the pit, utilizing the prior art techniques, must make at least two trips to the construction site, including one trip to set up the rebar and forms and pour the concrete, and then a second trip after the cementitious material has properly hardened to remove the forms.

Also, the surfaces of the pit are formed by cementitious material adjacent the forms. While cementitious material exhibits sufficient strength characteristics in compression, it is susceptible to cracking and failure in tension loads. Hence, the cementitious material is necessarily not the most desirable material for forming walls of the pit in which the dynamometer is located. Accordingly, a need exists to provide a pit assembly which can be utilized as a form during pouring of the cementitious material but which can remain within the cementitious material and form a lining for the dynamometer pit or other related pit, after the cementitious material has hardened, such that no removal of any portion of the pit assembly is necessary after hardening.

SUMMARY OF THE INVENTION

This invention provides a pit assembly which includes a pan which acts as a surface liner for a dynamometer pit and which includes a rebar cage affixed thereto which is properly spaced from the pan to provide the required reinforcement surrounding the pan. This pit assembly is placed at the desired location and in the desired orientation for the dynamometer pit. Cementitious material is then ready to be poured around the pit in a manner surrounding and covering the rebar cage of the pit assembly and coming up into contact with outer surfaces of the pan. The interior of the pit assembly remains open. After the cementitious material has hardened, the dynamometer pit is completely formed. No portion of the pit assembly needs to be removed after the cementitious material has hardened.

The pan is in the form of a rigid open-topped enclosure with two side walls, an end wall, an access wall and a floor. The access wall provides a convenient location where conduits can be coupled to the pan, such as for providing power to equipment located within the pan and/or for plumbing conduits associated with pumps to remove unwanted liquids which might collect within the pan. The floor preferably slopes from an upper end to a lower end so that liquids collect within a single region within the pan. This sloping character can end with a sump adjacent the lower end, and below the lower end in which a pump can be located.

The rebar cage includes ties which rigidly connect the rebar cage to the pan. The rebar cage additionally includes a lattice of rebar including, for instance, a top loop, a bottom loop, an intermediate sloping loop, and a series of U-bars located within planes perpendicular to planes in which the loops are oriented. The rebar cage can thus provide the rebar at the precise location where required relative to the pan, to provide maximum reinforcement for the pan.

OBJECTS OF THE INVENTION

Accordingly, a primary object of the present invention is to provide a pit assembly for use in the formation of a dynamometer pit or other pit below a surface of cementitious material.

Another object of the present invention is to provide a pit assembly which can form a pit in a surface of cementitious material without requiring the installation and removal of temporary forms.

Another object of the present invention is to provide a pit assembly which includes a rebar cage surrounding the pit at a location desired for reinforcement of the cementitious material surrounding the pit.

Another object of the present invention is to provide a pit assembly which is capable of being prefabricated at a first location and then transported to a second installation location, such as a vehicle service bay.

Another object of the present invention is to provide a pit assembly which includes a liner for the pit in the form of a pan.

Another object of the present invention is to provide a pit assembly which includes a sump region where a pump can be located for the removal of unwanted liquids which might collect within the pit assembly.

Another object of the present invention is to provide a pit assembly which is sized to receive a dynamometer therein and at least some of the equipment associated with the operation of the dynamometer.

Other further objects of the present invention will become apparent from a careful reading of the included drawing figures, the claims and detailed description of the invention.

DESCRIPTION OF THE PREFERRED EMBODIMENT

Figure 1:
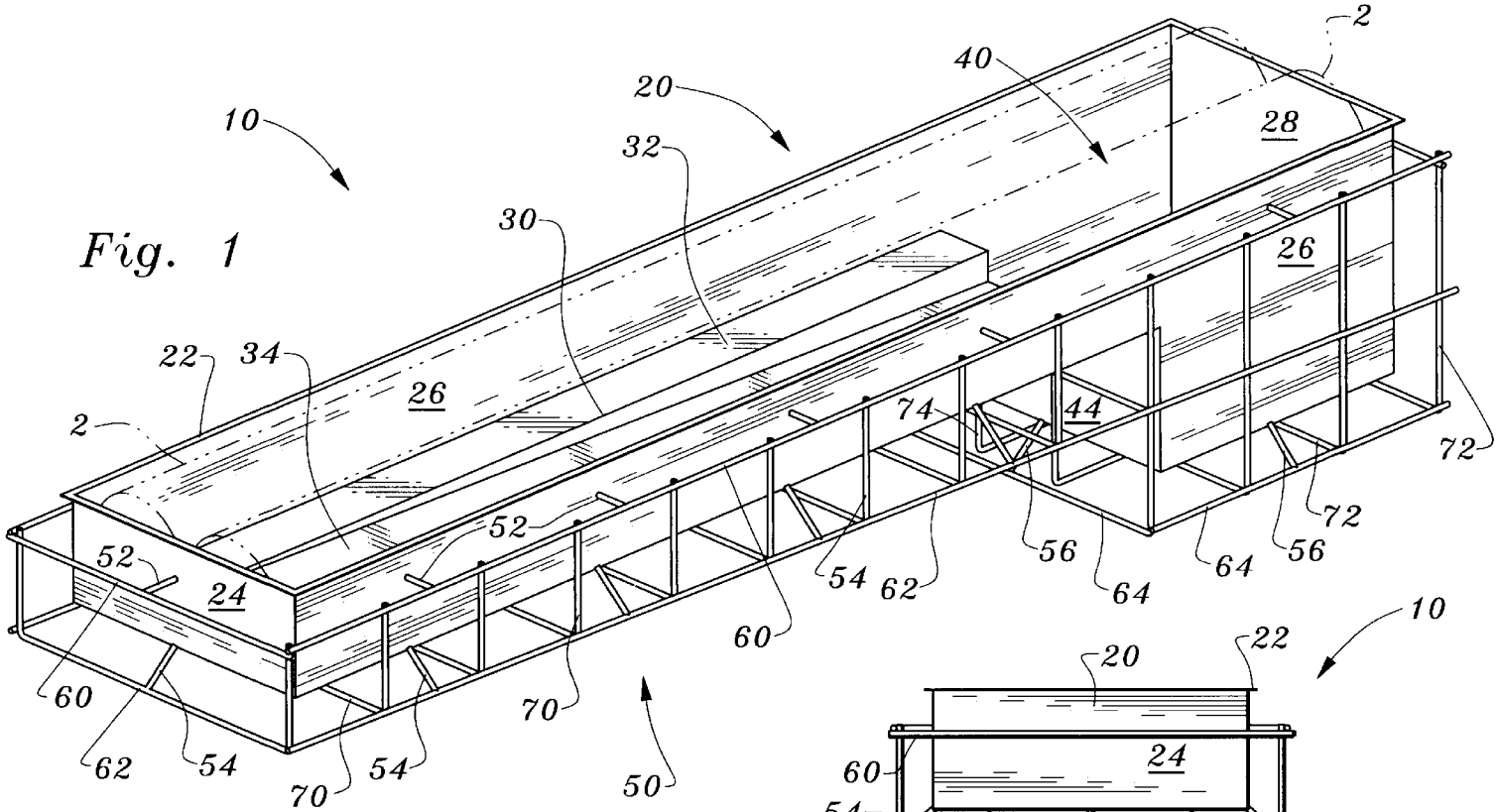
FIG. 1 is a perspective view of the pit assembly of this invention before cementitious material has been poured in a manner surrounding the pan of the pit assembly and around the various segments within the rebar cage.
Figure 2:
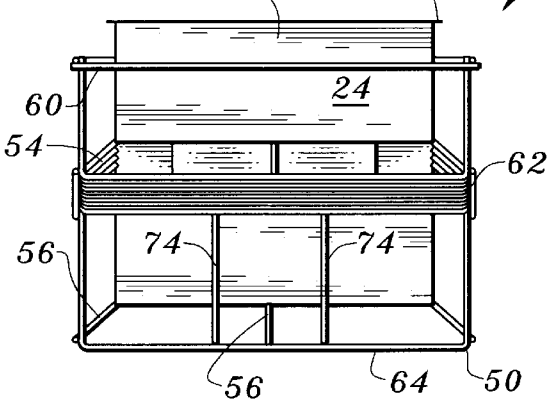
FIG. 2 is a left side view of that which is shown in FIG. 1.

Referring to the drawings, wherein like reference numerals represent like parts throughout the various drawing figures, reference numeral 10 is directed to a pit assembly for use in installing a dynamometer pit into cementitious material, such as within a floor of a vehicle service bay. The pit assembly 10 includes an open-topped pan 20 surrounded by a rebar cage 50.

In essence, and with particular reference to FIG. 1, the primary features of the pit assembly 10 are described. The pan 20 of the pit assembly 10 forms an open-topped enclosure 20 with a floor 30 defining a lower portion of the pan 20. A sump 40 preferably is provided at one end of the pan 20, and is located at level below the floor 30 to collect liquids flowing off of the floor 30, for collection and removal, such as with a pump. A rebar cage 50 surrounds the pan 20. The rebar cage 50 provides a lattice of rebar segments surrounding the pan 20 on all sides of the pan 20 except for the open top of the pan 20. Hence, when cementitious material is poured around the pan 20, the rebar cage 50 is embedded with the cementitious material. The pan 20 has an interior thereof which remains unfilled by the cementitious material and defines a pit where a dynamometer or other equipment can then be installed.

More specifically, and with particular reference to FIGS. 1, 2 and 4–6, particular details of the pan 20 are described. The pan 20 is preferably a rigid elongate hollow construct having an open top. The pan 20 can be formed from a variety of materials, but is preferably formed from steel. The particular characteristics of the steel are selected to provide the desired strength and corrosion properties to be effective in the dynamometer pit environment.

The pan 20 includes a rim 22 which surrounds the open top of the pan 20. The rim 22 preferably is oriented entirely within a horizontal plane which is substantially coplanar with a surface of the cementitious material, after the cementitious material has been poured surrounding the pan 20. The rim 22 preferably has a lip which extends outward from the pan 20 slightly. Lateral sides of the pan 20 include an end wall 24, two parallel and opposite side walls 26 and an access wall 28 parallel to the end wall 24. Preferably, the side walls 26 are located closer to each other than a distance between the end wall 24 and the access wall 28, such that the pan 20 is elongate. The various walls 24, 26, 28 are preferably each oriented substantially within a vertical plane and perpendicular to adjacent walls 24, 26, 28.

The access wall 28 can include a variety of different ports therein to facilitate easy attachment of conduits 29 to provide access into the pan 20 other than through the open top of the pan 20. For instance, a small hole in the access wall 28 can be provided for attachment of an electrical conduit 29 thereto. Electric power supply lines and other cards or wires 27 can then be passed into the pan 20 through the conduit 29 and through the access wall 28. Additionally, a pump outlet line can pass through the access wall 28 for attachment with an outlet of a pump. Because the pan 20 is susceptible to liquids collecting therein, it may be desirable to locate a pump within the pan 20 which could then readily remove liquids which might collect in the pan 20. Other conduits could additionally be provided for sensors, control signals and other pathways which might be required for the operation of a dynamometer 2 within the pan 20, or other equipment which might be located within the pan 20.

A majority of a lower surface of the pan 20 is defined by a floor 30. The floor 30 preferably includes two horizontal ledges 32 located adjacent each of the side walls 26. The ledges 32 abut the end wall 24 and extend toward each other and away from the side walls 26. The ledges 32 stop short of each other at a sloping trough 34 located between the ledges 32. The sloping trough 34 is located below a level of the ledges 32 and has sides connecting edges of the sloping trough 34 to edges of the ledges 32. The sloping trough 34 includes an upper end 36 adjacent the end wall 24 and a lower end 38 opposite the upper end 36. The lower end 38 is at a lower level than the upper end 36. Hence, if liquids collect within the pan 20, liquids will migrate off of the ledges to the sloping trough 34 of the floor 30 and be directed toward the lower end 38 of the sloping trough 34.

Preferably, the floor 30 does not define the entire lower side of the pan 20. Rather, a remaining portion forms a sump 40. The sump 40 includes a bottom wall 42 located at a level below the lower end 38 of the sloping trough 34 of the floor 30. The sump 40 thus defines a lowermost portion of the pan 20. The sump 40 provides a convenient location where a pump can be located to remove liquids which might collect within the pan 20. The vertical distance between the floor 30 of the pan 20 and the bottom wall 42 of the sump 40 is spanned by a short wall 44 which extends down from the floor 30 to the bottom wall 42. Hence, the entire pan 20 is enclosed except for the top which is surrounded by the rim 22. The dimensions of the pan 20 are provided as desired to house equipment for which the pit's construction in the cementitious material has been designed. If the pit is to house a dynamometer, the pan 20 will have a depth and length sufficient to house the various different components of the dynamometer.

Figures 3, 4:
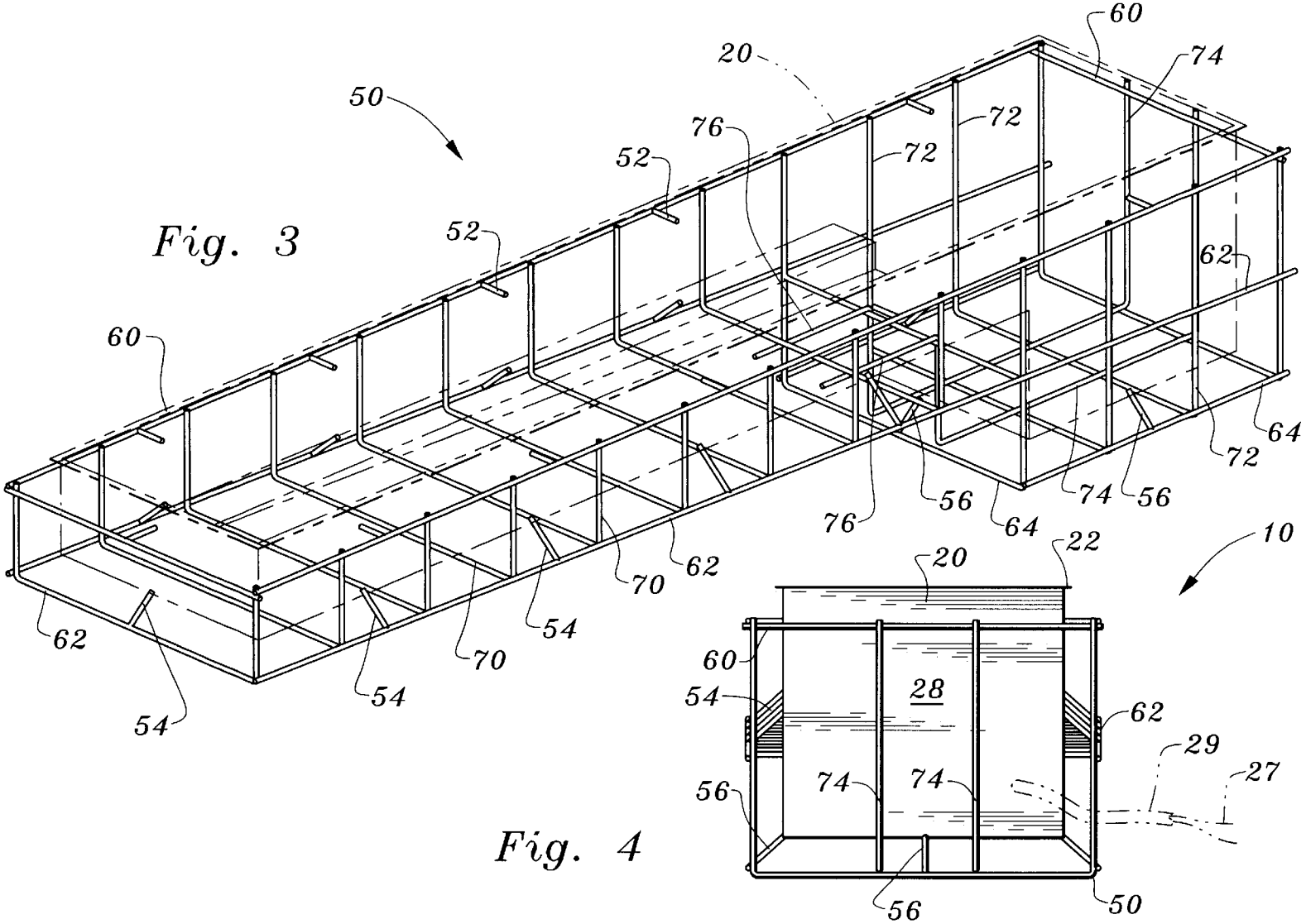
FIG. 3 is a perspective view of that which is shown in FIG. 1 with the pan of the pit assembly shown in phantom and revealing specific details of the rebar cage of the pit assembly.
FIG. 4 is a right end view of that which is shown in FIG. 1.
Figure 5:
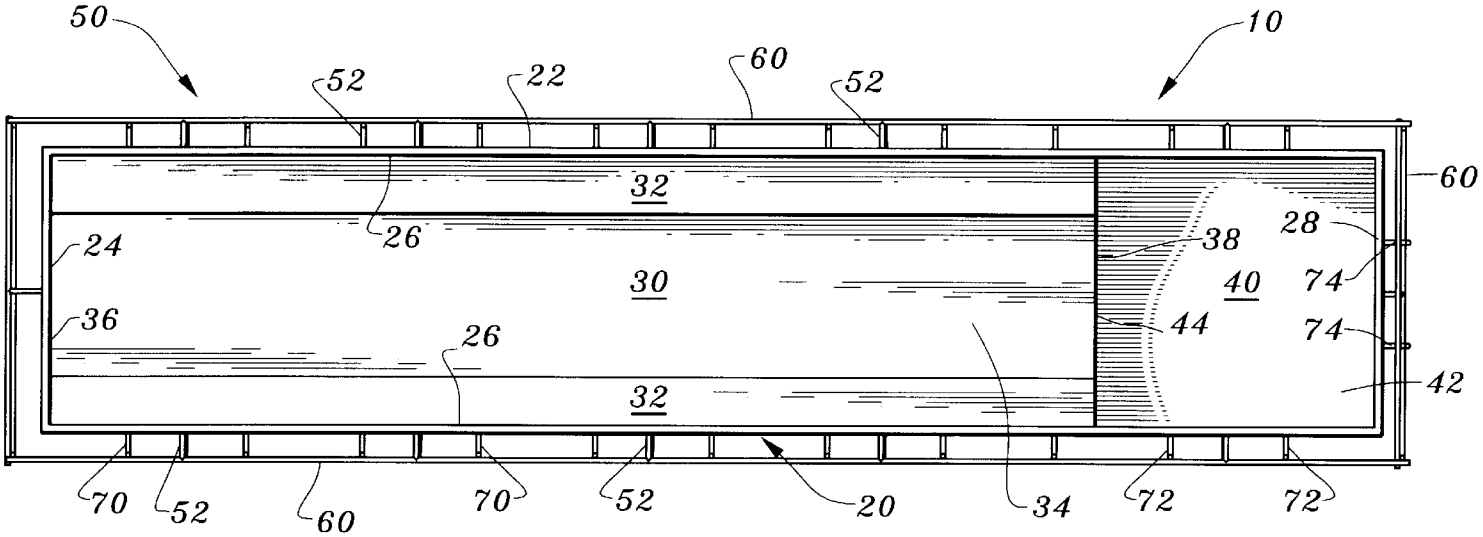
FIG. 5 is a top plan view of that which is shown in FIG. 1.
Figure 6:
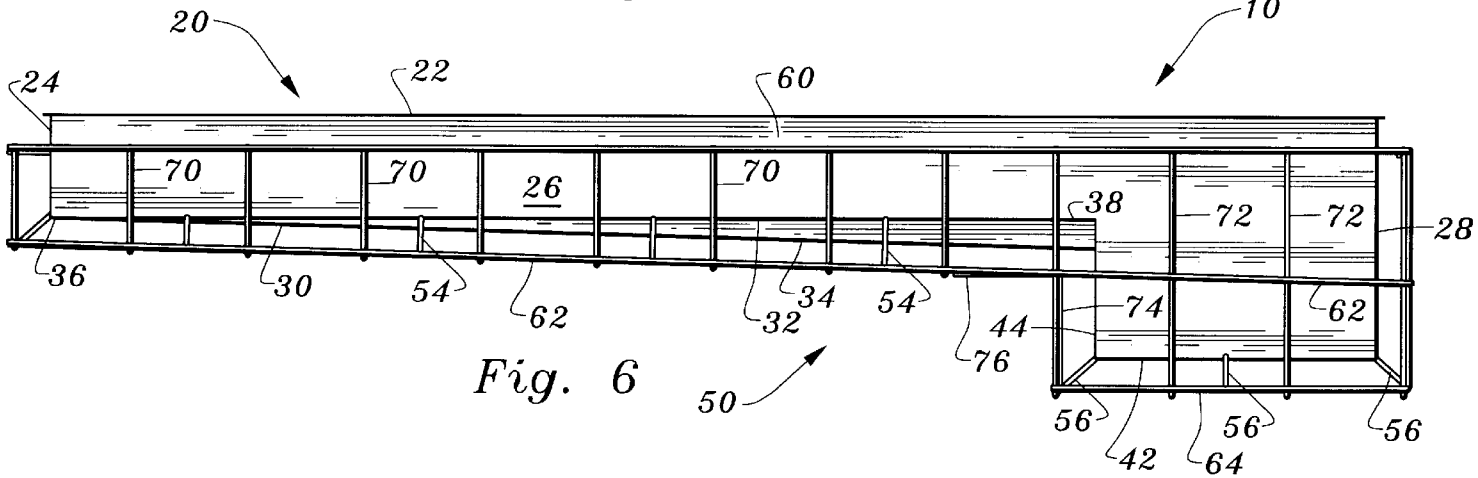
FIG. 6 is a front elevation view of that which is shown in FIG. 1.

With particular reference to FIG. 3, details of the rebar cage 50 of the pit assembly 10 are described. The rebar cage 50 is shown separate from the pan 20 in FIG. 3. However, the pan 20 and rebar cage 50 preferably are rigidly attached together with no significant motion or flexing between the rebar cage 50 and the pan 20. The rebar cage 50 is configured to provide the desired level of reinforcement to cementitious material surrounding the pan 20 of the pit assembly 10. Typically, rebar is arrayed in an area where reinforcement is desired with segments of the rebar oriented in mutually perpendicular directions. Such an arrangement is preferred for the rebar cage 50 of this invention. However, various different orientations of individual rebar segments could be utilized surrounding the pan 20 to provide the desired level of reinforcement to the pit assembly 10.

In the most preferred orientation for the rebar cage 50, upper ties 52 extend horizontally away from the side walls 26 and end wall 24 and rigidly tie the rebar cage 50 to the pan 20. Lower ties 54 extend from edges between the end wall 24 or side wall 26 and the floor 30, diagonally down to portions of the rebar cage 50 located below the floor 30 of the pan 20. Sump ties 56 extend diagonally down from edges between the side walls 26 and the bottom wall 42 out to the various segments of the rebar cage 50 adjacent the sump ties 56. The various ties 52, 54, 56 provide for secure and rigid attachment between the pan 20 and the rebar cage 50, so that a single pit assembly 10 is provided.

The rebar cage 50 preferably includes a top loop 60 which extends within a horizontal plane completely surrounding the pan 20. The top loop 60 is located below a level of the rim 22, and coplanar with the upper ties 52, so that the top loop 60 is entirely embedded within the cementitious material when the cementitious material is poured to a level equal to that of the rim 22. A sloping loop 62 is preferably located vertically below the top loop 60. The sloping loop 62 additionally preferably is located closer to the top loop 60 adjacent the end wall 24 of the pan 20 and further from the top loop 60 adjacent the access wall 28 of the pan 20. In this way, the sloping loop 62 tends to follow somewhat the angle of the sloping through 34 in the floor 30 of the pan 20. Because the lower ties 54 attach to the sloping loop 62, the lower ties 54 are of various lengths depending on their spacing between the sloping loop 62 and the floor 30 of the pan 20. The sloping loop 62 preferably does not completely surround the pan 20. Rather, the sloping loop 62 is preferably discontinuous adjacent the access wall 28 of the pan 20, so that conduits can more readily access various different locations on the access wall 28 of the pan 20.

A bottom loop 64 is located below the sloping loop 62 and surrounds the region where the bottom wall 42 of the sump 40 is located. The bottom loop 64 attaches to the sump ties 56, securing the bottom loop 64 and adjacent portions of the rebar cage 50 to the sump 40 of the pan 20.

A variety of different U-shaped bars are provided in vertical planes substantially perpendicular to planes in which the loops 60, 62, 64 are oriented, to form the lattice-like structure of the rebar cage 50. The U-shaped bars include short U-bars 70 which surround the floor 30 portion of the pan 20. Each short U-bar 70 includes vertical portions which extend from the top loop 60 to the sloping loop 62 and horizontal portions which extend horizontally between opposite sides of the sloping loop 62. Each of the short U-bars 70 has a different height, so that a spacing between the horizontal portion of each short U-bar 70 is maintained away from the sloping trough 34 of the floor 30.

Tall U-bars 72 are provided adjacent the sump 40 of the pan 20. The tall U-bars 72 are oriented similarly to the short U-bars 70, except that they have longer vertical portions to accommodate the enhanced depth of the sump 40 relative to the floor 30.

Uneven U-bars 74 are oriented within vertical planes perpendicular to the vertical planes in which the short U-bars 70 and tall U-bars 72 are oriented. The uneven U-bars 74 include vertical legs adjacent the access wall 28 of the pan 20 and the short wall 44 of the sump 40 of the pan 20. The uneven U-bars 74 preferably include horizontal legs 76 which extend from tops of vertical portions of the uneven U-bars 74 adjacent the short wall 44. The horizontal legs 76 extend partially beneath the sloping trough 34 of the floor 30. Preferably, wherever various different segments of the rebar cage 50 intersect with other segments of the rebar cage 50, the rebar segments are tied, welded or otherwise attached together.

Figure 7:
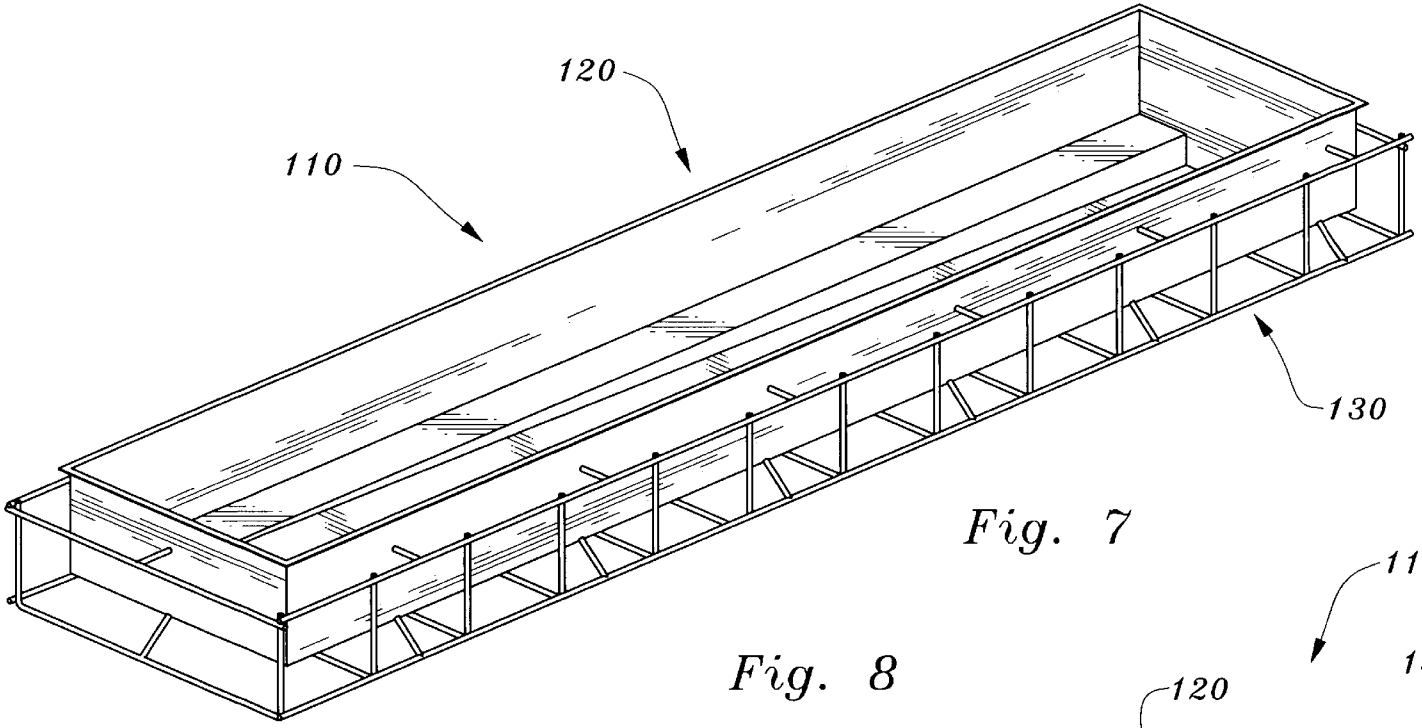
FIG. 7 is a perspective view of an alternative embodiment of that which is shown in FIG. 1.
Figure 8:
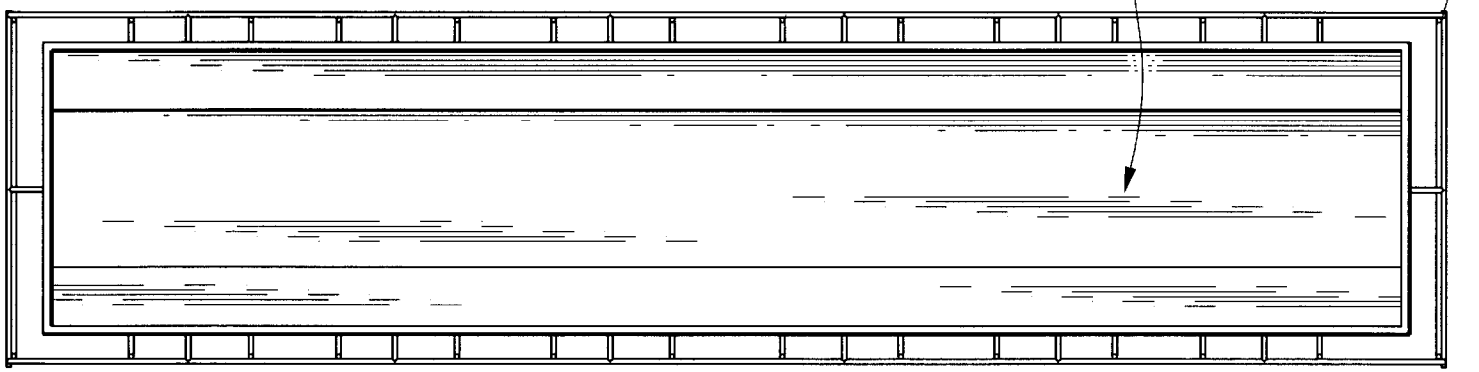
FIG. 8 is a top plan view of that which is shown in FIG. 7.

With particular reference to FIGS. 7 and 8, details of a partial flush mount pit assembly 110 are provided. The preferred pit assembly 10 of FIGS. 1–6 show a flush mount pit assembly 10 which includes the sump 40 within the pan 20. The partial flush mount pit assembly 110 is similar to the pit assembly 10 of the preferred embodiment except that an alternate pan 120 is provided which does not include a sump. Rather, the alternate pan 120 includes a contour similar to that of the floor 30 portion of the pan 20 alone, without the sump 40 of the pit assembly 10 of the preferred embodiment. The alternate pan 120 is longer than the floor 30 portion of the pan 20 of the preferred embodiment. The specific dimensions of the alternate pan 120 are provided by merely extending the contours of the various surfaces of the floor 30 so that the floor 30 of the preferred embodiment is elongated to provide the entire lower surface of the pit assembly 110. The partial flush mount pit assembly 110 additionally includes an alternate rebar cage 130 surrounding the alternate pan 120 and securely attached to the alternate pan 120. The alternate rebar cage 130 is modified from the rebar cage 50 of the preferred embodiment merely to maintain a spacing between segments of the alternate rebar cage 130 away from surfaces of the alternate pan 120 at a relatively constant distance. Specifically, the alternate rebar cage 130 does not include any tall U-bars or uneven U-bars to accommodate a sump, because the alternate pan 120 does not include a sump. The partial flush mount pit assembly 110 can be utilized in construction sites where collection of liquid within the pit assembly 110 is not deemed to be a significant concern and/or where a limited vertical depth is available for installation of the partial flush mount pit assembly 110.

In use and operation, the pit assembly 10 or partial flush mount pit assembly 110 are utilized in the following similar manner. Initially, a location is provided where it is desired that a pit extend down into cementitious material below a surface of the cementitious material. For instance, when a dynamometer is to be installed within a vehicle service bay, it is desirable that the floor of the vehicle service bay, which is formed of cementitious material, include a pit in which the dynamometer equipment can be located, such that a vehicle can be driven off of the floor of the service bay and onto the dynamometer with a minimum of difficulty.

The region surrounding where the pit is to be located is excavated sufficiently so that the pit assembly 10 (or alternate pit assembly 110) can be placed, with the rim 22 coplanar with the surface desired for the cementitious material. Once the pit assembly 10 has been properly located, cementitious material is poured around the pit assembly 10. The cementitious material is allowed to flow through the rebar cage 50 and up against surfaces of the pan 20. If desired, conduits can be coupled to the access wall 28 of the pan 20 to provide access into the pan 20 in a manner other than through the open top of the pan 20. With the conduits attached to the access wall 28, the cementitious material is prevented from flowing into the pan 20 through the access wall 28. Once the cementitious material has been poured up to the rim 22 of the pan 20, the cementitious material is allowed to harden. When the cementitious material has fully hardened, the installation of the pit into the cementitious material is completed. Hence, the otherwise necessary steps of removing forms and carefully placing rebar surrounding the forms is eliminated. Desired equipment can then be located within the pit, such as locating dynamometer equipment within the pit formed by the pit assembly 10.

This disclosure is provided to reveal a preferred embodiment of the invention and a best mode for practicing the invention. Having thus described the invention in this way, it should be apparent that various different modifications can be made to the preferred embodiment without departing from the scope and spirit of this disclosure. When structures are identified as a means to perform a function, the identification is intended to include all structures which can perform the function specified.

What is claimed is:

1. An apparatus for use in installing a dynamometer into cementitious material by providing a pit below a level of a surface of the cementitious material, the apparatus comprising in combination:

a rigid pan, said pan having a floor with side walls extending upward therefrom;

a rebar cage located at least partially below said pan and at least partially around said side walls of said pan;

a plurality of ties joining said rebar cage to said pan; and a dynamometer located above said floor with at least a portion of said dynamometer located within said side walls of said pan.

2. The apparatus of claim 1 wherein said pan has an open top defined by a rim surrounding said pan within a horizontal plane said rim larger than said dynamometer, such that said dynamometer within said pit is accessed through said rim.

3. The apparatus of claim 2 wherein said rebar cage is located entirely below said rim of said pan, such that when cementitious material is poured around said pan up to said rim, said rebar cage is entirely below a surface of the cementitious material.

4. The apparatus of claim 1 wherein said ties are rigid, such that said pan and said rebar cage form a single rigid pit assembly.

5. The apparatus of claim 4 wherein said ties include upper ties which extend horizontally away from said side walls of said pan to said rebar cage, and lower ties extending diagonally down from an edge between said floor and said side walls of said pan, each of said ties extending between said pan and said rebar cage.

6. The apparatus of claim 1 wherein said floor of said pan is at least partially sloped from an upper end of said floor to a lower end of said floor.

7. The apparatus of claim 6 wherein said pan includes a sump located beyond said lower end of said floor and below said lower end of said floor, such that liquids upon said floor drain down to said sump.

8. The apparatus of claim 1 wherein a port passes through said pan with a conduit coupled to said port.

9. The apparatus of claim 8 wherein at least one wire passes through said conduit and said port and into said pan, said wire coupled to said dynamometer.

10. The apparatus of claim 9 wherein said wire is an electric power supply line coupled to said dynamometer and providing electric power to said dynamometer.

11. The apparatus of claim 9 wherein said wire is a sensor wire coupled to said dynamometer.

12. The apparatus of claim 11 wherein said pan is sized to match closely a size and shape of said dynamometer.

13. An apparatus for use in installing a dynamometer into cementitious material by providing a pit below a level of a surface of the cementitious material, the apparatus comprising in combination:

a rigid pan, said pan having a floor with side walls extending upward therefrom;

a rebar cage located at least partially below said pan and at least partially around said side walls of said pan;

a plurality of ties joining said rebar cage to said pan;

wherein said floor of said pan is at least partially sloped from an upper end of said floor to a lower end of said floor;

wherein said pan includes a sump located beyond said lower end of said floor and below said lower end of said floor, such that liquids upon said floor drain down a sloping trough to said sump; and wherein said floor includes two horizontal ledges on opposite sides of said sloping trough in said floor, said ledges having a constant width and extending from an end wall of said pan to said sump, said sump including a horizontal bottom wall located below said lower end of said floor; and wherein said pan includes an access wall opposite said end wall and adjacent said sump, said access wall including at least one port for accessing said sump through said access wall.

14. The apparatus of claim 13 wherein said pan has an open top defined by a rim surrounding said pan within a horizontal plane; and wherein said rebar cage is located entirely below said rim of said pan, such that when cementitious material is poured around said pan up to said rim, said rebar cage is entirely below a surface of the cementitious material.

15. The apparatus of claim 14 wherein said rebar cage extends laterally beyond both said side walls, said end wall and said access wall of said pan and below said floor and said bottom wall of said sump.

16. The apparatus of claim 15 wherein said rebar cage includes a top loop extending entirely around said pan within a horizontal plane below said rim of said pan;

wherein said rebar cage includes a sloping partial loop located entirely below said top loop and below said floor of said pan, said sloping loop coupled to lower ties joining said sloping loop to a junction between said floor and said side walls of said pan; and wherein said rebar cage includes short U-bars oriented within a vertical plane and extending down from said top loop to said sloping loop and beneath said floor of said pan, tall U-bars extending vertically down from said top loop and beneath said bottom wall of said sump, and uneven U-bars extending within a vertical plane down from said top loop adjacent said access wall, beneath said bottom wall of said sump and at least partially beneath said floor, said uneven U-bars oriented in a plane perpendicular to a vertical plane in which said tall U-bars and said short U-bars are oriented.

17. A method for installing a pit below a level of a surface of cementitious material to provide space for a dynamometer at least partially below the surface of the cementitious material, the method including the steps of:

providing a rigid pan, the pan having a floor with side walls extending upward therefrom, a rebar cage located at least partially below the pan and at least partially around the side walls of the pan, a plurality of ties joining the rebar cage to the pan, such that a pit assembly is provided;

placing said pit assembly at a desired location with the rebar cage located below an intended level of the surface of the cementitious material and with a portion of the pan of the pit assembly located at least as high as the intended level of the surface of the cementitious material;

pouring the cementitious material around the pit assembly up to the intended level for the surface of the cementitious material; and locating a dynamometer above the floor with at least a portion of the dynamometer located within the side walls of the pan.

18. The method of claim 17 including the further step of adding at least one conduit connecting to an access wall in the pan, such that a pathway through the access wall of the pan is provided by the conduits, before said pouring step.

19. The method of claim 18 including the further step of routing an electric power supply line through the at least one conduit; and connecting the electric power supply line to the dynamometer.

20. The method of claim 17 including the further steps of identifying at least one drive wheel of a motor vehicle; and positioning the drive wheel of the motor vehicle upon the dynamometer within the rigid pan of the pit, such that the dynamometer can be used in conjunction with the motor vehicle.

* * * * *